United States Patent [19]

Schaeffler

[11] Patent Number: 4,716,865

[45] Date of Patent: Jan. 5, 1988

[54] INNER ELEMENT FOR A HYDRAULIC COMPENSATION ELEMENT

[75] Inventor: Georg Schaeffler, Herzogenaurach, Fed. Rep. of Germany

[73] Assignee: Motomak Motorenbau, Maschinen- und Werkzeugfabrik, Konstruktionen GmbH, Fed. Rep. of Germany

[21] Appl. No.: 13,001

[22] Filed: Feb. 10, 1987

[30] Foreign Application Priority Data

Feb. 21, 1986 [DE] Fed. Rep. of Germany ..... 3605645

[51] Int. Cl.[4] ..... F01L 1/24

[52] U.S. Cl. ..... 123/90.55; 123/90.46

[58] Field of Search ..... 123/90.55, 90.56, 90.57, 123/90.58, 90.59, 90.46, 90.43

[56] References Cited

U.S. PATENT DOCUMENTS

| | | | |
|---|---|---|---|
| 2,941,523 | 6/1960 | Bergmann | 123/90.55 |
| 3,358,660 | 12/1967 | Cornell | 123/90.55 |
| 3,516,393 | 6/1970 | Dadd | 123/90.55 |
| 4,227,495 | 10/1980 | Krieg | 123/90.55 |
| 4,502,428 | 3/1985 | Paar | 123/90.46 |
| 4,621,398 | 11/1986 | Miura | 123/90.55 |
| 4,644,913 | 2/1987 | Stoody | 123/90.55 |
| 4,644,914 | 2/1987 | Morita et al. | 123/90.55 |

FOREIGN PATENT DOCUMENTS

| | | | |
|---|---|---|---|
| 150914 | 8/1984 | Japan | 123/90.55 |
| 206914 | 10/1985 | Japan | 123/90.55 |

*Primary Examiner*—Ira S. Lazarus

*Attorney, Agent, or Firm*—Bierman & Muserlian

[57] ABSTRACT

An inner element for a hydraulic valve clearance compensation element for an internal combustion engine comprising a cylindrical element (3) closed on one end and a piston element (5) guided therein for longitudinal displacement and protruding beyond the open end of cylindrical element (3), the piston element (5) having a reduced outer diameter (6) in its protruding portion engaging a radial flange (10) of a restraining element (9) held by a cylindrical collar (13) on the open end of cylindrical element (3), the open end of element (3) having also a reduced outer diameter (7) with an additional diameter reduction in the form of a peripheral groove (8) engaging positively the collar (13) of the restraining element (9) at at least some peripheral points, the restraining element (9) having one projection (11) at at least one peripheral point radially protruding beyond the outer diameter of cylindrical element (3), characterized in that the lengthwise region of collar (13) containing projections (11) engaging radially over the outer diameter of cylindrical element (3) and the lengthwise region of collar (13) engaging peripheral groove (8) of cylindrical element (3) lie axially behind one another without a mutual overlap.

1 Claim, 3 Drawing Figures

INNER ELEMENT FOR A HYDRAULIC COMPENSATION ELEMENT

STATE OF THE ART

Inner elements for hydraulic valve clearance compensation element for internal combustion engines are known wherein a cylindrical element closed on one end and a piston element guided therein for longitudinal displacement and protruding beyond the open end of cylindrical element, the piston element having a reduced outer diameter in its protruding portion, engaging a radial flange of a restraining element held by a cylindrical collar on the the open end of cylindrical element, the open end of element having also a reduced outer diameter with an additional diameter reduction in the form of a peripheral groove engaging positively the collar of the restraining element at at least some peripherial points, the restraining element having one projection at at least one peripheral point radially protruding beyond the outer diameter of cylindrical element. Such elements are inserted into the bores of the rocker arms or valve lifters with which they cooperate.

To prevent the inner elements from sliding out of the bores into which they are inserted before the entire hydraulic valve clearance compensation element is peraanently installed, the projection radially protruding beyond the outer diameter of the cylindrical element engages a diameter enlargement of the bore in which the inner element is inserted. Such a diameter enlargement of the bore does not have to be produced separately because it is provided during normal machining operation at the end of the bore to permit the removal of the machining tool.

When securing the restraining element at the end of the cylindrical element, the cylindrical collar must be conformed into the peripheral groove with a radially acting stampling tool at several peripheral points and in the known construction, this requires a separate alignment step to prevent the stamping tools from engaging the points where the radial projections which protrude beyond the outer diameter of the cylindrical element are provided. Only by this step does one avoid damaging the projections or rendering them entirely inoperative during the stamping operation.

OBJECTS OF THE INVENTION

It is an object of the invention to provide a novel construction for securing the restraining element to the cylindrical element in a simple manner without a separate alignment step.

This and other objects and advantages of the invention will become obvious from the following detailed description.

THE INVENTION

The novel inner element of the invention for a hydraulic valve clearance compensation element for an internal combustion engine comprises a cylindrical element (3) closed on one end and a piston element (5) guided therein for longtudinal displacement and protruding beyond the open end of cylindrical element (3), the piston element (5) having a reduced outer diameter (6) in its protruding portion engaging a radial flange (10) of a restraining element (9) held by a cylindrical collar (13) on the the open end of cylindrical element (3), the open end of element (3) having also a reduced outer diameter (7) with an additional diameter reduction in the form of a peripheral groove (8) engaging positively the collar (13) of the restraining element (9) at at least some peripheral points, the restraining element (9) having one projection (11) at at least one peripheral point radially protruding beyond the outer diameter of cylindrical element (3) characterized in that the lengthwise region of collar (13) containing projections (11) engaging radially over the outer diameter of cylindrical element and the lengthwise region of collar (13) engaging peripheral groove (8) of cylindrical element (3) lie axially behind one another without a mutual overlap.

Referring now to the drawings.

Figure 1:
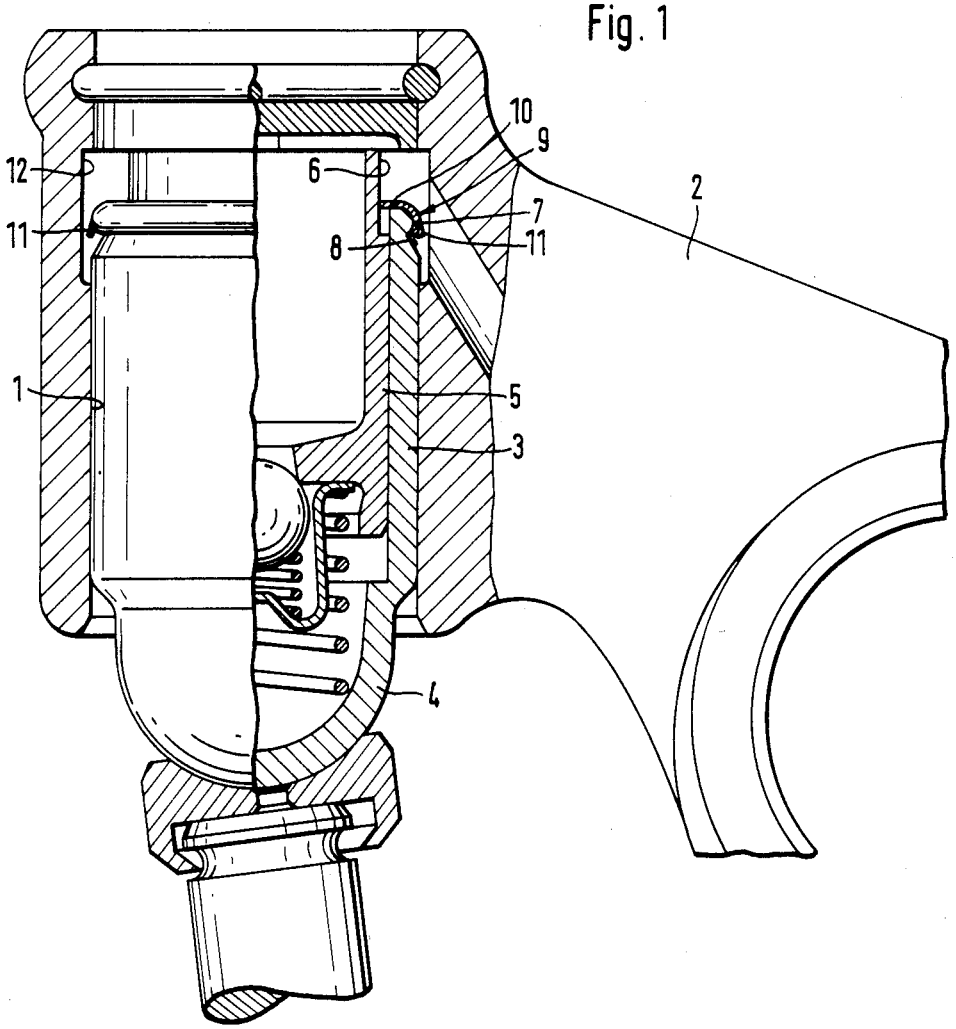
FIG. 1 is a cross-section of an inner element of the invention inserted into a rocker arm.

In FIG. 1, the inner element is inserted into bore 1 of a rocker arm 2 which consists of cylindrical element 3 with a closed end 4 and piston element 5 longitudinally guided therein. Piston element 5 contains a known check valve and a helical spring is placed between the piston element and cylindrical element which urges the two elements apart. Piston element 5 protrudes from the open end of cylindrical element 3 and has a reduced outer diameter 6 in this area. Cylindrical element 3 is provided at the open end with a reduced outer diameter 7 in the area of which a peripheral groove 8 is additionally provided.

A restraining element 9 is placed on the reduced end 7 of cylindrical element 3 and engages by radial flange 10 the reduced diameter area 6 of the piston element to prevent the piston element 5 from sliding out of the cylindrical element 3. At several peripheral points on the cylindrical collar of restraining element 9 which is forced into groove 8 for retention of the restraining element are projections 11 protruding beyond the outer diameter of cylindrical element 3 while engaging diameter enlargement 12 at the end of bore 1 of the rocker arm 2. The projections 11 prevent the entire inner element from sliding out of bore 1.

Figure 2:
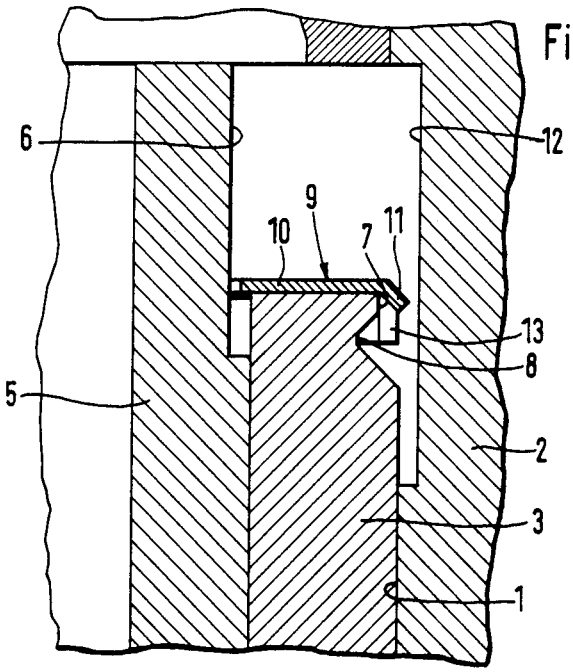
FIG. 2 is an enlarged partial view of the restraining element placed on the cylindrical element in its initial state.

The enlarged detail of FIG. 2 shows the restraining element 9 in its initial state with radial flange 10 and cut out projections 11 at several peripheral points bent outwardly at an angle and over the remainder of the circumferential region is cylindrical collar 13.

Figure 3:
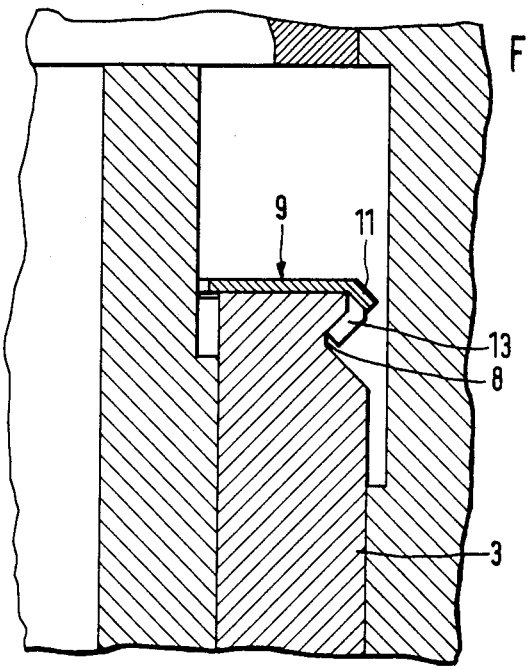
FIG. 3 is an enlarged partial view of the same restraining element after it has been secured to the cylindrical element.

In FIG. 3, the restraining element 9 is secured to cylindrical element 3 by shaping radially inwardly the cylindrical collar 13 by a tool so that it positively engages peripheral groove 8. Since the the area of cylindrical collar 13 which is forced into the peripheral groove 8 lies entirely below the area in which the projections 11 are located, the deformation of collar 13 is possible without the shaping tools touching the region of the projections 11 which reduces any danger that the projections 11 will be effected during deformation of the collar 13.

It should be understood that the placing of the restraining element 9 on the cylindrical element 3 and its attachment thereto is effected before the inner element is inserted into bore 1 of the rocker arm 2. In FIG. 2, the inner element is shown as if it had already been inserted into bore 1 only to indicate how projections 11 cooperate with the diameter enlargement 12 of bore 1.

Various modifications of the inner elements of the invention may be made without departing from the spirit or scope thereof and it is to be understood that the invention is intended to be limited only as defined in the appended claim.

What I claim is:

1. An inner element for a hydraulic valve clearance compensation element for an internal combustion engine comprising a cylindrical element (3) closed on one end and a piston element (5) guided therein for longitudinal displacement and protruding beyond the open end of cylindrical element (3), the piston element (5) having a reduced outer diameter (6) in its protruding portion engaging a radial flange (10) of a restraining element (9) held by a cylindrical collar (13) on the open end of cylindrical element (3), the open end of element (3) having also a reduced outer diameter (7) with an additional diameter reduction in the form of a peripheral groove (8) engaging positively the collar (13) of the restraining element (9) at at least some peripheral points, the restraining element (9) having one projection (11) at at least one peripheral point radially protruding beyond the outer diameter of cylindrical element (3), characterized in that the lengthwise region of collar (13) containing projections (11) engaging radially over the outer diameter of cylindrical element (3) and the lengthwise region of collar (13) engaging peripheral groove (8) of cylindrical element (3) lie axially behind one another without a mutual overlap.

* * * * *